US007114208B1

(12) United States Patent
Borst

(10) Patent No.: US 7,114,208 B1
(45) Date of Patent: Oct. 3, 2006

(54) COMBINATION HAND TOOL FOR WIRE BUNDLE MAINTENANCE

(75) Inventor: Randall W. Borst, Costa Mesa, CA (US)

(73) Assignee: Thomas M. Lynch, Costa Mesa, CA (US)

( * ) Notice: Subject to any disclaimer, the term of this patent is extended or adjusted under 35 U.S.C. 154(b) by 0 days.

(21) Appl. No.: 11/192,248

(22) Filed: Jul. 27, 2005

(51) Int. Cl.
*B25B 25/00* (2006.01)
*B25F 1/00* (2006.01)
*B25B 7/22* (2006.01)

(52) U.S. Cl. ..... 7/108; 7/107; 7/125

(58) Field of Classification Search ..... 7/108, 7/107, 125, 132, 129, 5.4, 5.3, 6; 81/9.4, 81/415–417; 140/123; D8/51, 52, 55
See application file for complete search history.

(56) References Cited

U.S. PATENT DOCUMENTS 744,167 A 11/1903 Collins
815,455 A 3/1906 Smith
1,364,829 A * 1/1921 Berg ..... 7/130
2,153,510 A * 4/1939 Bowen ..... 30/90.2
2,729,996 A * 1/1956 Schoenwald ..... 7/108
2,774,268 A * 12/1956 Kagan ..... 29/270
2,787,925 A * 4/1957 Buchanan ..... 72/402
3,733,627 A 5/1973 Epstein
3,860,981 A * 1/1975 Mayer ..... 7/108
4,266,587 A * 5/1981 Wood ..... 81/436
4,878,406 A * 11/1989 Simpson et al. ..... 81/436
4,987,626 A * 1/1991 Montgomery et al. ..... 7/127
5,461,944 A * 10/1995 Ciumaga ..... 76/119
5,799,381 A * 9/1998 Gannon et al. ..... 29/268
5,918,337 A * 7/1999 Evling et al. ..... 7/108
6,487,941 B1 * 12/2002 Ping ..... 81/300
2003/0150062 A1 8/2003 Muirhead

* cited by examiner

*Primary Examiner*—Lee D. Wilson
*Assistant Examiner*—Alvin J. Grant
(74) *Attorney, Agent, or Firm*—Gene Scott, Patent Law & Venture Group

(57) ABSTRACT

A tool of the manual pliers type has a pair of levers pivotally joined for moving the levers into abutment wherein terminal ends of the levers form a continuous screwdriver blade, a stripping aperture, a cutting enablement, a crimping enablement, and further provides a pair of opposing gripping notches, one of the notches terminating in the screwdriver blade.

7 Claims, 4 Drawing Sheets

COMBINATION HAND TOOL FOR WIRE BUNDLE MAINTENANCE

BACKGROUND

1. Field of the Present Disclosure

This disclosure relates generally to hand tools of the pliers type, i.e., with jaws that may be used for gripping, cutting and stripping a wire.

2. Description of Related Art

Muirhead, U.S. Pat. No. 2003/0,150,062, discloses a wire stripper with integral screwdriver that has a pair of levers pivotally connected at a fulcrum point to each other. Each lever has a handle and a jaw on opposite sides of the fulcrum point. The jaws have a plurality of notches of different curvatures, which come together in a closed state for stripping insulation from electrical wires of different gauges, and also have a scissors area for cutting electrical wires. One of the jaws is extended and includes an integral screwdriver tip. In a preferred embodiment, when the tool is in a closed position, the handles are closed together to form a single integral screwdriver handle. The tool can be used for stripping wire and screwing down electrical connections. Collins, U.S. Pat. No. 744,167, discloses a tool comprising pivotally-connected levers, jaws that have cooperating straight clamping-surfaces, one jaw having a segmental notch and the other jaw further having ratchet-like teeth, the points of which teeth extend approximately in the same plane as the clamping-surface of the jaw and the faces of which teeth extend parallel to each other and longitudinally of the first lever. Smith, U.S. Pat. No. 815,755, discloses a wire-splicer comprising a shank having a return-bend or hook for holding or seating the dormant wire therein, a lateral shoulder or projection for engaging the wire to be coiled or wound around the dormant wire, and means for opposing the strain exerted upon the dormant wire by the coiling operation and holding the dormant wire firmly seated in the hook. Berg, U.S. Pat. No. 1,364,829, discloses a tool comprising handless and gripping jaws at the end of the handles, one of the jaws formed with a curved outer face and a recess at the inner terminal of the curved face, to form a cutting edge substantially coequal with the width of the jaw, the curved face of the jaw and the recess extending substantially in the direction of but obliquely to the longitudinal axis of the tool to form a plane or draw-knife cutting edge with a curved bearing surface back thereof. Bowen, U.S. Pat. No. 2,153,510, discloses a BX cable cutter comprising two levers pivoted together intermediate of their ends to provide long and short portions, the longer portions being used as handles and the shorter portions being sharpened to be used as handles and the shorter portions being sharpened to be used as shear jaws, one jaw being longer than the other and having a blunt end portion extending beyond the end of the shorter jaw, and the longer jaw being provided with a notch in its cutting face to locate the end of the shorter jaw. Schoenwald, U.S. Pat. No. 2,729,996, discloses a hand tool comprising a primary handle of appreciable cross-section having its outward end centrally and longitudinally bifurcated, the furcations and the intervening space providing a fork-like sheath, a first implement embodying a first jaw and a shank, the latter in alignment with and fixedly joined to the outer end of one furcation, an auxiliary handle superimposed against and pivoted to the shank and foldable in part into the sheath, the auxiliary handle having an offset second jaw opposed to, coplanar with and movable toward and from the first jaw, the primary handle having a first recess in one side aligned with and constituting a pocket-like tension of the sheath, the second jaw being wholly foldable into an out-of-the-way position in the extension, and the primary handle having a second recess in a side opposite to the first named side and providing a second extension of the sheath and the auxiliary handle being foldable in part into the second extension. Epstein, U.S. Pat. No. 3,733,627, discloses a Combination tool of particular utility to electricians or other craftsmen, handymen, mechanics or the like, for performing any of a plurality of operations involved in terminating electrical wires including cutting of wires, stripping of insulation therefrom, crimping solderless terminals, forming screw connection loops and turning screws. Evling et al., U.S. Pat. No. 5,918,337, discloses a multi-purpose tool comprising a fish hook screwdriver to quickly and accurately trace electrical wires. The user-friendly fish hook screwdriver has a screwdriver blade to move, separate or spread a bundle or harness of wires and has a hook which can conveniently slide along the wire being traced. Advantageously, the hook can also hook, pull and lift the wires being traced, as desired. The hook can be an internal hook which extends into the blade or shank. The hook can also be an external hook which extends outwardly from the blade or shank. The hook can have different configurations and sizes to accommodate different size wires. Chao-Chin Yen, G. B. 2392318, discloses a wire stripping tool that is mounted within two attached handles. A catch releasably secures the two handles together against the action of a spring. Another tool, preferably a screwdriver, peeling hook or peeling knife, is attached to one handle. Preferably a cutting blade is received within one handle or stripping blades are received within both handles. The preferred stripping blades include rows of semi-cylindrical cutting edges.

Our prior art search with abstracts described above teaches pliers type tools with cutting and gripping surfaces, spaced openings between jaws for clearance of gripped objects, sharpened front edges, hooked features, hammer features, screwdriver attachments, gauged spacing for stripping insulation, and snap-in replacement elements. However, the prior art fails to teach the combination of features taught in the present apparatus which combination is of particular importance for the specialty work of telephone line hookup and repair service personnel. The present disclosure distinguishes over the prior art providing heretofore unknown advantages as described in the following summary.

SUMMARY

This disclosure teaches certain benefits in construction and use which give rise to the objectives described below.

A tool of the manual pliers type has a pair of levers pivotally joined for moving the levers into abutment wherein terminal ends of the levers form a thin continuous screwdriver blade, a stripping aperture, a cutting enablement, a crimping enablement, and further provides a pair of opposing gripping notches, one of the notches terminating in the screwdriver blade. In operations necessary for installation and maintenance of wire bundles, such a tool is extremely advantageous.

A primary objective inherent in the above described apparatus and method of use is to provide advantages not taught by the prior art.

Another objective is to provide a single tool useful for conducting for all of the work elements in installing and maintaining wire bundles.

A further objective is to provide a single hand tool capable of operating as a driver, a wire finder, a wire puller, a wire cutter, a wire stripper and a wire crimper.

Other features and advantages of the described apparatus and method of use will become apparent from the following more detailed description, taken in conjunction with the accompanying drawings, which illustrate, by way of example, the principles of the presently described apparatus and method of its use.

BRIEF DESCRIPTION OF THE DRAWINGS

The accompanying drawings illustrate at least one of the best mode embodiments of the present apparatus and method of it use. In such drawings:

FIG. 5 is an enlarged partial perspective view of the apparatus showing its usefulness for gripping a wire and pulling it into a position where it can be operated on;

DETAILED DESCRIPTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 1:
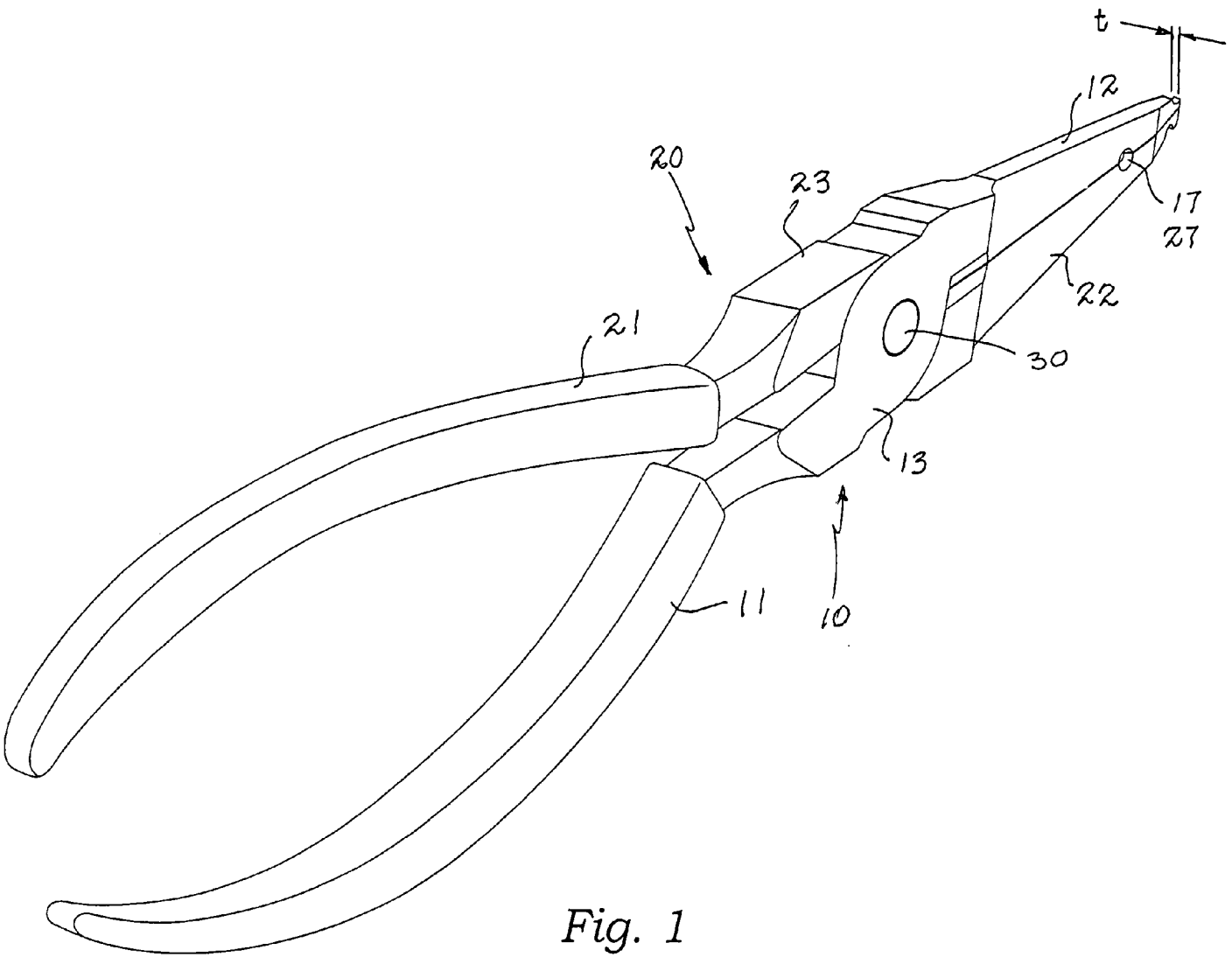
FIG. 1 is a perspective view the presently described tool apparatus.
Figure 2A:
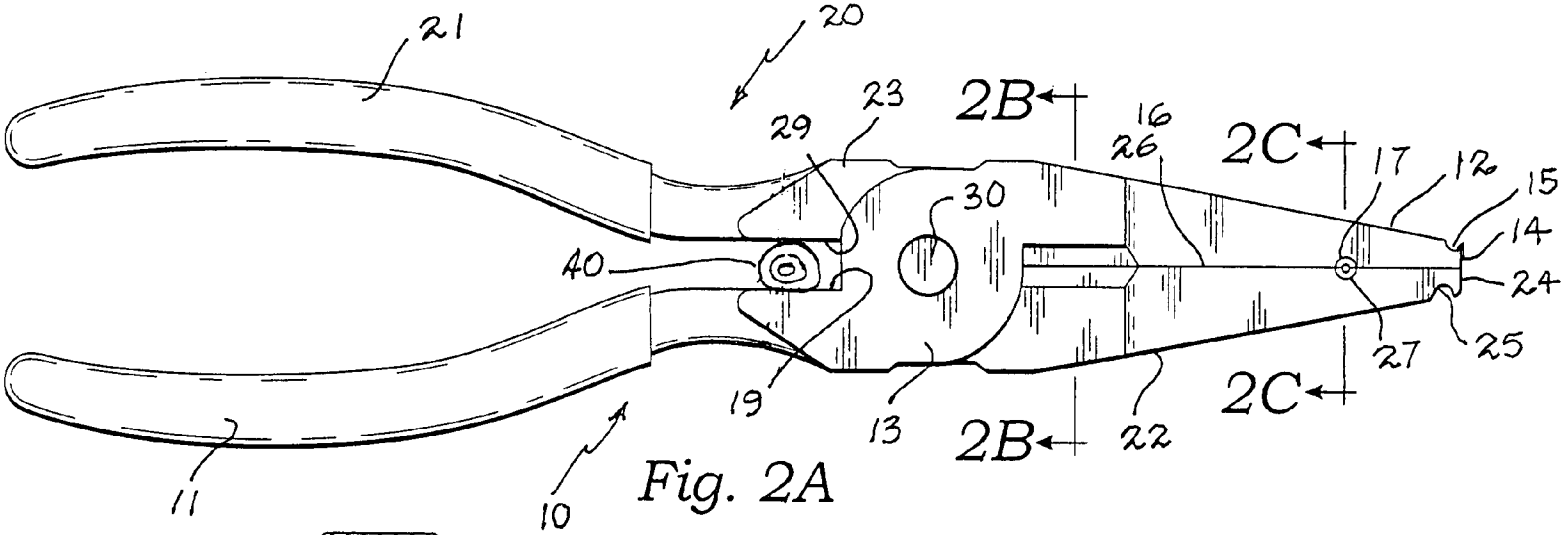
FIG. 2A is a side elevational view thereof showing the tool with closed jaws and further showing a wire nut being compressed or crimped.

The presently described hand tool, as shown in FIGS. 1 and 2A, is made up of a first lever 10 including a proximal first handle portion 11, a distal first jaw portion 12 and a medial first intermediate portion 13 between the first handle portion 11 and the first jaw portion 12, wherein, the first jaw portion terminates with a first screwdriver blade 14 and a first hooking notch 15, wherein, the first hooking notch 15 intersects the first screwdriver blade 14. The first jaw portion 12 further provides a first gripping surface 16 extensive from the first screwdriver blade 14 to the first intermediate portion 13, and a first wire stripping aperture 17 open to the first gripping surface 16.

A second lever 20 includes a proximal second handle portion 21, a distal second jaw portion 22 and a medial second intermediate portion 23 positioned between the second handle portion 21 and the second jaw portion 22. The second jaw portion 22 terminates with a second screwdriver blade 24 and a second hooking notch 25, wherein the second hooking notch 25 is proximal to the second screwdriver blade; 24 but does not intersect with it. The second jaw portion 22 further provides a second gripping surface 26 extensive between the second screwdriver blade 24 and the second intermediate portion 23. A second wire stripping aperture 27 is open to the second gripping surface 26.

The first intermediate portion 13 provides a pair of first cutting edges 18' and 18" arranged in side-by-side juxtaposition and a first crimping surface 19, while the second intermediate portion 23 provides a pair of second cutting edges 28' and 28" arranged in side-by-side juxtaposition and a second crimping surface 29.

Figure 2C:
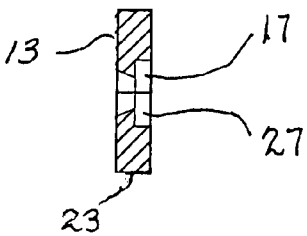
FIG. 2C is a sectional view taken along line 2C—2C in FIG. 2A.
Figure 2B:
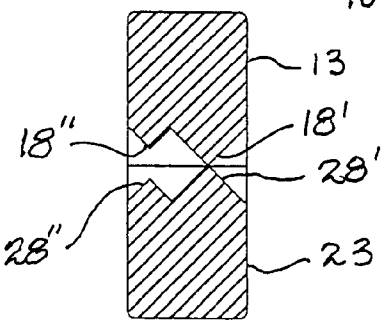
FIG. 2B is a sectional view taken along line 2B—2B in FIG. 2A.

The first and second intermediate portions 13 and 23 are pivotally connected together by pivot axel 30, enabling the handle portions 11 and 21, the jaw portions 12 and 22, and the intermediate portions 13 and 23 to be pivotally moved alternately toward and away from each other and into abutment thereby forming a continuous screwdriver blade comprising the first and second screwdriver blades 14 and 24, and forming a continuous mutually contacting gripping surface comprising the first and second gripping surfaces 16 and 26, and forming a joint stripping aperture comprising the first and second stripping apertures 17 and 27, and forming pairs of opposing cutting edges comprising the first and second pairs of cutting edges 18', 28' and 18', 28" as shown in FIG. 2B, and forming opposing crimping surfaces comprising the first and second crimping surfaces 19 and 29 as shown in FIG. 2C.

Figure 3:
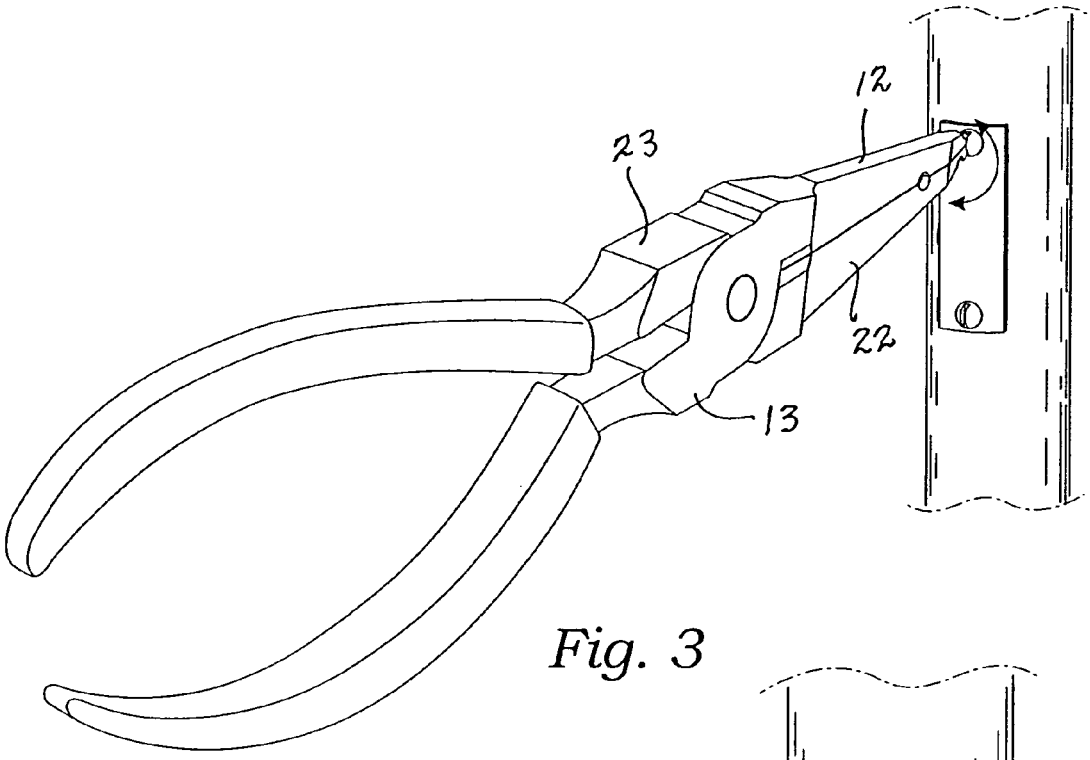
FIG. 3 is a perspective view of the apparatus showing its usefulness as a screwdriver for removing plates and such.
Figure 4:
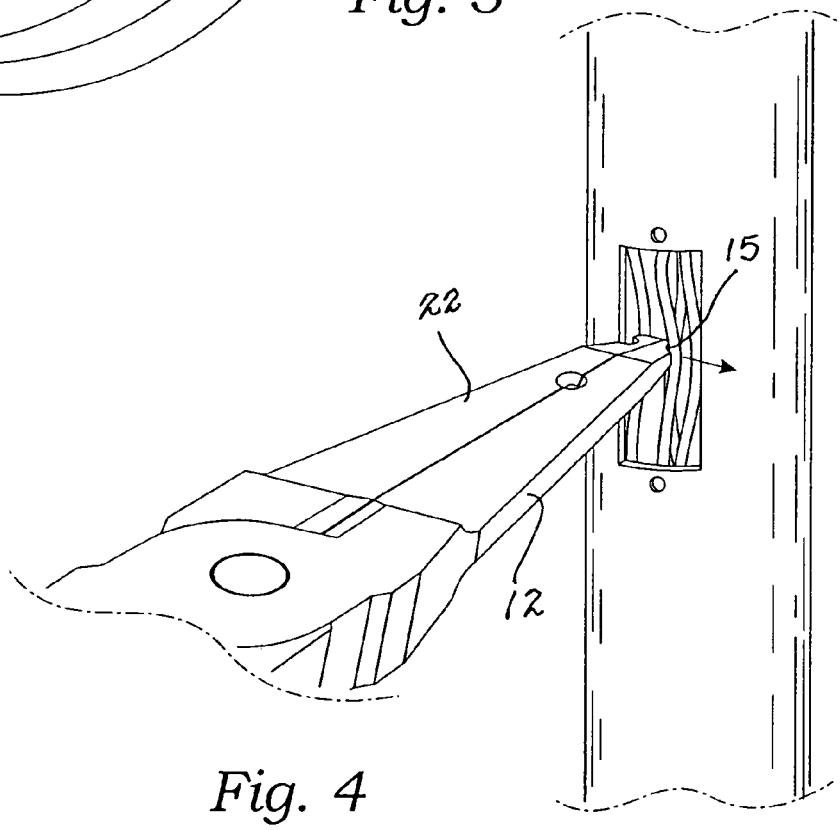
FIG. 4 is an enlarged partial perspective view of the apparatus showing its usefulness for snagging a wire and moving it into position for gripping it.
Figure 5:
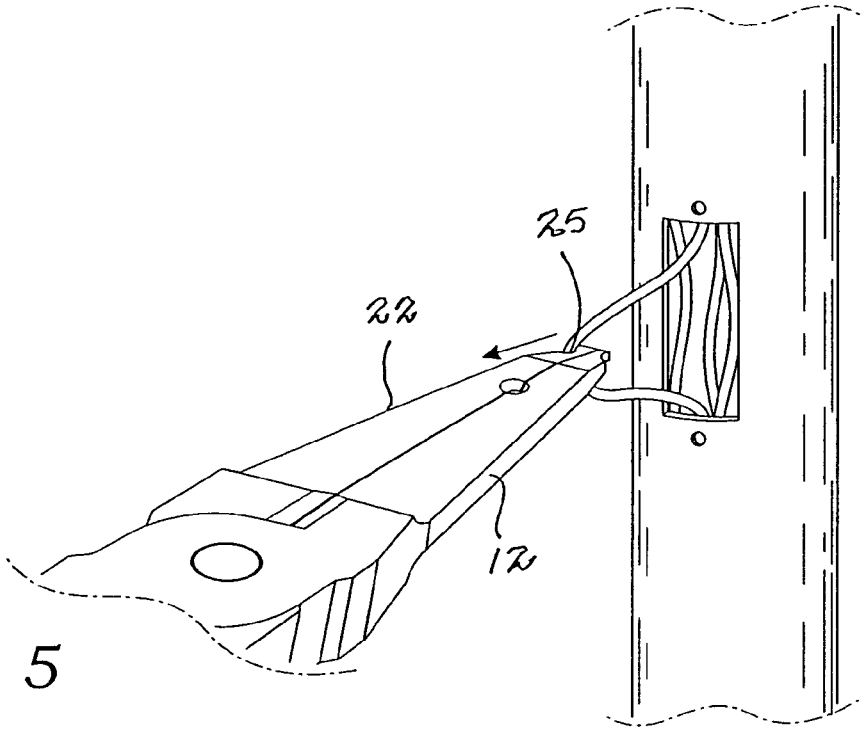
Figure 6:
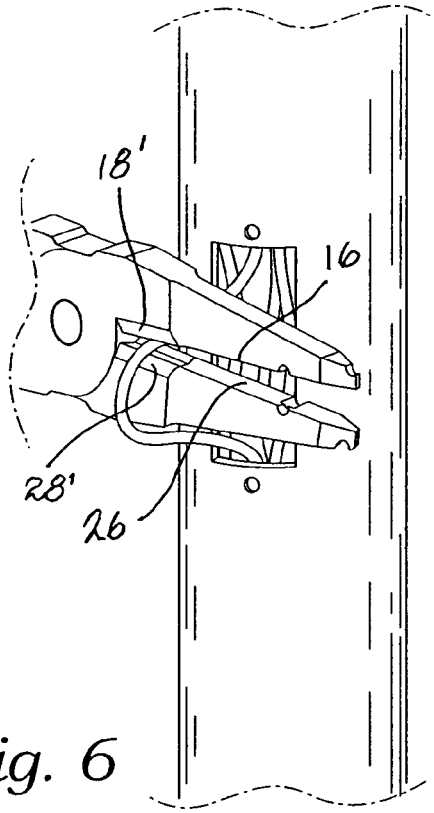
FIG. 6 is a partial perspective view of the apparatus showing its usefulness for cutting a wire.
Figure 7:
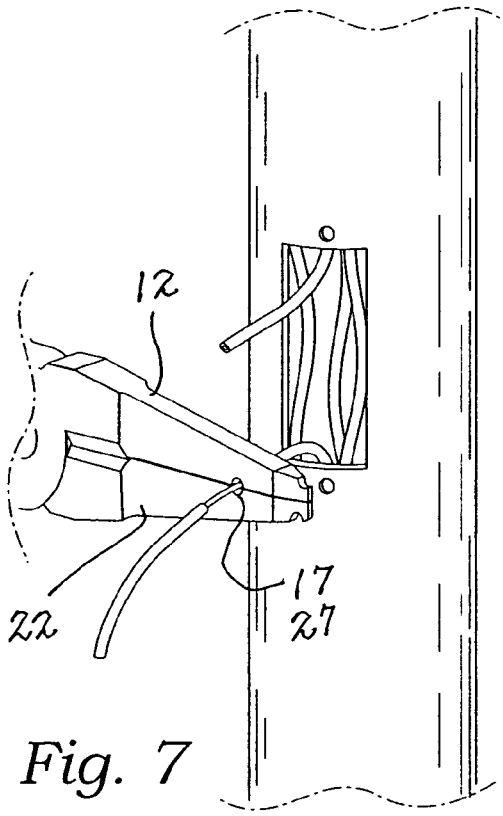
FIG. 7 is a partial perspective view of the apparatus showing its usefulness for stripping a wire.

It is evident from the foregoing that the present tool is useful for certain repetitive operations conducted by those providing wiring services in the telephone network and similar systems where many electrical wires are used and need to be found, cut and spliced from time to time. The present apparatus, as shown in FIG. 3 is useful, when the jaws are closed, for removing access screws with blades 14 and 24 to gain access to wires in need of service. As shown in FIG. 4, the hooking notch 15 is useful for culling out and gaining control of a particular wire. This is possible because the notch 15 is partially situated on the blade 14 so that the blade does not interfere with the access of the notch 15 to the wire. This is clearly shown in FIG. 4. As shown in FIG. 5, the notch 25 may then be advanced into the wires and the selected wire may be engaged by notch 25 which allows the wire to be pulled into a position where it can be further addressed. As shown in FIG. 6, the wire may then be cut using blades 18' and 18", or for certain types of wires, by using blades 18" and 28". Next, the cut wires may be stripped using stripping apertures 17 and 27 as shown in FIG. 7. When wires need be joined, a wire nut or ferrule 40 (FIG. 2A) may be used wherein crimping forces may be developed using surfaces 19 and 29. It should be noted that the foregoing operations may be performed, in the same order as described, by a screwdriver for removing screws, an awl for searching through the wires and finding the targeted wire, a crochet needle or needle nose pliers, for hooking the selected wire and pulling it into a position for access, a cutting pliers for severing the wire, a stripping tool for stripping the wire, and a crimping tool for joining wires with a ferrule. Using such an array of tools has been common practice in industry to perform this work, however, a single tool with all of the above capabilities enables the work to be accomplished much faster and with less effort. The time and effort necessary to place one tool back into ones tool belt or kit while retrieving the next tool is saved by the use of the instant apparatus tool. Additionally, the worker need not take eyes off of the workpiece, a further important benefit. It should be noted that the terminal end of the apparatus is preferably no thicker than about one-thirty-second of an inch; see dimension "t" in FIG. 1. This is an important consideration and allows the tool to be used to ferret through a bunch of loose wires to select the one of choice. It has been found that tools with a wider blade are not suitable for certain applications such as installation and maintenance work on telephone plant wire bundles.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are (literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A tool comprising:

a first lever including a proximal first handle portion, a distal first jaw portion and a medial first intermediate portion between the first handle portion and the first jaw portion, the first jaw portion terminating with a first screwdriver blade and a first hooking notch, the first hooking notch intersecting the first screwdriver blade forming a point directed in line with the first screwdriver blade, the first jaw portion further providing a first gripping surface extensive from the first screwdriver blade to the first intermediate portion, and a first wire stripping aperture open to the first gripping surface;

a second lever including a proximal second handle portion, a distal second jaw portion and a medial second intermediate portion between the second handle portion and the second jaw portion, the second jaw portion terminating with a second screwdriver blade and a second hooking notch, the second hooking notch proximal to the second screwdriver blade but not intersecting therewith, the second jaw portion further providing a second gripping surface extensive from the second screwdriver blade to the second intermediate portion, and a second wire stripping aperture open to the second gripping surface;

the first intermediate portion providing a pair of first cutting edges arranged in side-by-side juxtaposition and a first crimping surface;

the second intermediate portion providing a pair or second cutting edges arranged in side-by-side juxtaposition and a second crimping surface;

wherein, the first and second intermediate portions are pivotally connected together enabling the first and second jaw and intermediate portions to be moved alternately toward and away from each other and into abutment thereby forming a continuous screwdriver blade comprising the first and second screwdriver blades, and forming a continuous mutually contacting gripping surface comprising the first and second gripping surfaces, and forming a joint stripping aperture comprising the first and second stripping apertures, and forming opposing cutting edges comprising the first and second cutting edges, and forming opposing crimping surfaces comprising the first and second crimping surfaces.

2. A tool according to claim 1 wherein the first and second screwdriver blades are not thicker then one-thirty second of an inch.

3. A tool comprising: a pair of levers pivotally joined for moving the levers into abutment wherein terminal ends of the levers form a continuous screwdriver blade, a hooking notch terminating in intersection with the screwdriver blade forming a point directed in line with the first screwdriver blade.

4. A tool according to claim 3 wherein the levers each provide a handle portion for manual operation, a jaw portion for applying work, and a medial intermediate portion joined by a pivot.

5. A tool according to claim 3 wherein the jaw portions each provide a gripping surface and a wire stripping aperture open to the gripping surfaces.

6. A tool according to claim 3 further comprising at least one pair of cutting edges and at least one pair of crimping surfaces.

7. A tool comprising: a first lever including a proximal first handle portion, a distal first jaw portion and a medial first intermediate portion between the first handle portion and the first jaw portion, the first jaw portion terminating with a first screwdriver blade and a first hooking notch, the first hooking notch intersecting the first screwdriver blade forming a point directed along the first screwdriver blade; a second lever including a proximal second handle portion, a distal second jaw portion and a medial second intermediate portion between the second handle portion and the second jaw portion, the second jaw portion terminating with a second screwdriver blade and a second hooking notch, the second hooking notch proximal to the second screwdriver blade but not intersecting therewith; wherein, the first and second intermediate portions are pivotally connected together enabling the first and second jaw and intermediate portions to be moved alternately toward and away from each other and into abutment thereby forming a continuous screwdriver blade comprising the first and second screwdriver blades.

* * * * *